33-241 SR
3/23/76 XR 3,945,127

United States Patent [19]

Spencer

[11] 3,945,127

[45] Mar. 23, 1976

[54] SIGHTING APPARATUS

[76] Inventor: Phillip G. Spencer, R.R. No. 6, Box 994, Kokomo, Ind. 46901

[22] Filed: Mar. 27, 1974

[21] Appl. No.: 455,368

[52] U.S. Cl. ..... 33/265; 33/241
[51] Int. Cl.[2] ..... F41G 1/32
[58] Field of Search ..... 33/241, 265; 200/61.47

[56] References Cited

UNITED STATES PATENTS

| | | | |
|---|---|---|---|
| 802,277 | 10/1905 | Fric | 33/241 |
| 2,140,655 | 12/1938 | Sloan | 200/61.47 |
| 2,767,472 | 10/1956 | Kocur | 33/265 |
| 3,455,027 | 7/1969 | Perkins | 33/265 |
| 3,524,440 | 8/1970 | Hill | 33/265 |
| 3,667,444 | 6/1972 | Depatie et al. | 33/265 |
| 3,678,590 | 7/1972 | Hayward | 33/241 |
| 3,815,271 | 6/1974 | Lynn | 33/241 |

*Primary Examiner*—Richard E. Aegerter
*Assistant Examiner*—Steven L. Stephan
*Attorney, Agent, or Firm*—Woodard, Weikart, Emhardt & Naughton

[57] ABSTRACT

A sighting device wherein from about 1 to about 10 sighting pins containing light conducting fibres are used to align the arrow, bullet or other projectile with the target. The sighting pins are adjustable both vertically and horizontally and are battery operated. The sight has utility for both hunting and target purposes. The entire device is small enough and light enough to be mounted on standard archery bows or rifles.

11 Claims, 4 Drawing Figures

SIGHTING APPARATUS

BACKGROUND OF THE INVENTION

1. Field of the Invention

This invention relates to sighting devices having projectable guides.

2. Description of the Prior Art

Although the sighting device of this invention is primarily concerned with archery and specifically the archery bow it also has utility for rifles and other forms of hunting and recreation wherein a projectile is aimed at a target. Archery is one of the most difficult of all sports due to the demand for consistent accuracy in order to enjoy success in this sport. The thing that makes archery so difficult is that each time the archer shoots an arrow he is faced with the necessity of adjusting several important variables. He must adjust the elevation of the arrow to compensate for distance. He must adjust the horizontal angle for windage. Even if he is able to complete these adjustments successfully, he must repeatedly draw the arrow each time to the same anchor point. The archer must further make sure that he does not torque the bow up, down or sideways. All of these variables and others require vary significant skills which are generally acquired only through experience. If compensation is not made for all of these variables then the net result must be that the target will be missed.

Traditionally, the archery bow is fired by the archer sighting along the length of the arrow and directing the arrowhead in predetermined relationship with respect to the target before releasing the arrow. As stated before, the desired alignment is normally controlled by the manual skill and dexterity of the archer which are, of course, only developed with experience. If the arrow falls long or short, the archer adjusts the sighting by realigning the head of subsequent arrows with a properly spaced point with regard to the target. Thus, the accuracy is essentially fully controlled by the archer's skill and furthermore is dependent upon maintaining the same fixed or selected positioned relationship between the bow, arrow and the archer at all times and for successive shots in order to properly aim the arrows. Thus, a need has been felt for mechanical sighting means which are both convenient for use and attachment to a bow and at the same time accurate.

Various types of bow sighting devices are available which have an assortment of methods for allowing for variable compensation. Some of these devices are best used for target archery where distances are known, while others are designed for actual hunting, where distances are unknown and where they change rapidly. Sample patents teaching various sighting devices include Depatie et al, U.S. Pat. No. 3,667,444 (1972); Hill, U.S. Pat. No. 3,524,440 (1970); and Westphal, U.S. Pat. No. 3,766,656 (1973).

SUMMARY OF THE INVENTION

This invention relates to a sighting device comprising an energy source for producing a distinct light from a light source and means for conducting said light to a point of illumination, generally a sighting pin which in turn can be used to sight stationary targets or to gauge moving targets.

It is therefore an object of this invention to provide a sighting device which is visible at night.

It is a further object of this invention to provide a sighting device containing light conductive fibres which will illuminate to be used as guide pins for sighting in both the daylight and at night.

These and other objects will become apparent from the following description of the preferred embodiments.

DESCRIPTION OF THE PREFERRED EMBODIMENT

Figure 1:
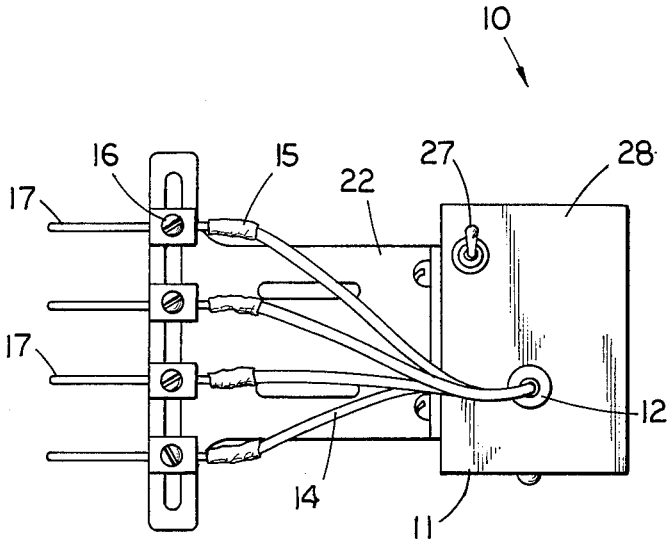
FIG. 1 is a front view of the assembled sighting apparatus.
Figure 3:
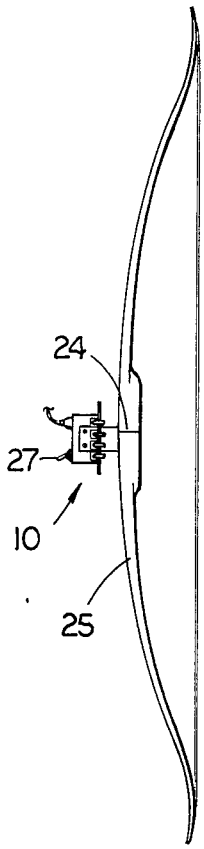
FIG. 3 is a side view of the assembled sighting apparatus as mounted on an archery bow.
Figure 4:
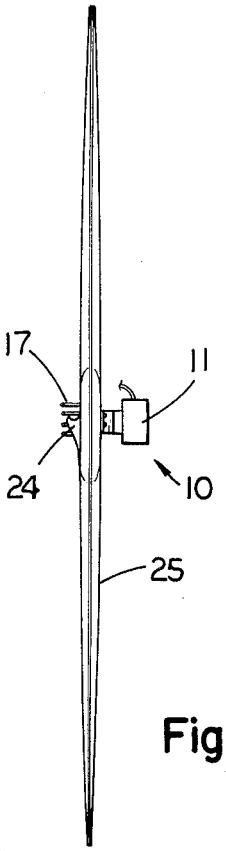
FIG. 4 is a rear view of the assembled sighting apparatus as mounted on an archery bow.
Figure 2:
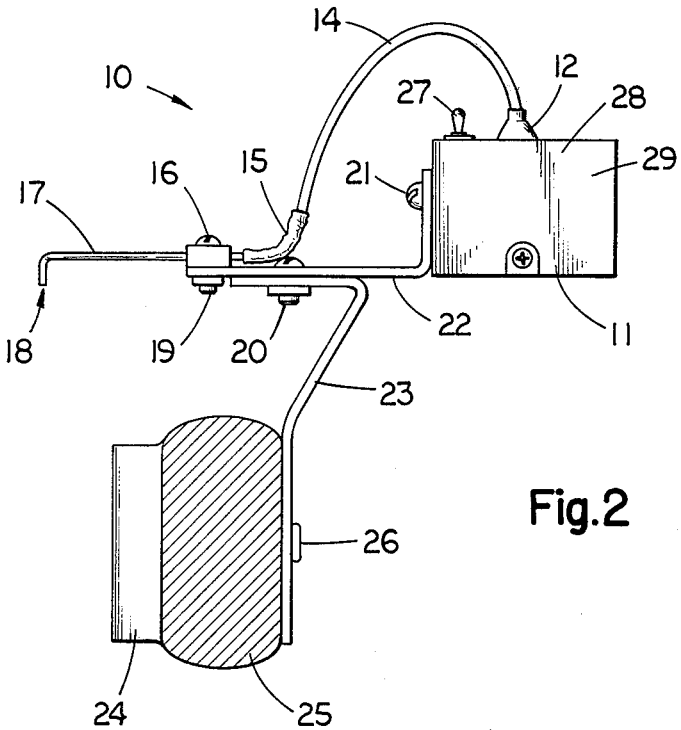
FIG. 2 is a top view of the assembled sighting apparatus as mounted on an archery bow.

For the purposes of promoting an understanding of the principles of the invention, reference will now be made to the embodiment illustrated in the drawings, and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The assembled sighting apparatus 10 is of the size and configuration that allows convenient mounting on both bows for archery purposes and rifles. The sight assembly 10 is designed so that the sighting pins 17 are in the proper viewing position whether a left-handed or a right-handed mount is used. This mounting position flexibility is a significant advantage over prior sighting devices in that the minority of left-handed archers and hunters have had an extremely difficult time finding adequate sights to allow them to compete with right-handed archers and hunters.

A power source 11 is mounted in a power source housing 29. This power source is any conventional battery. In general, the statement can be made that the smaller the battery, the more convenient will be the size and shape of the power source housing and the easier the light will be to construct and mount. Included in the power source housing 29 is a light source 28. The preferred light source is a red lens light. However, a red light or a red lens light is not essential, and any size or color of light that is desired and practical in terms of size and intensity may be used. A red light is preferred as it shows up clearly at night but at the same time does not cast light reflections which can attract the attention of game being pursued.

Power source 11 is activated by a switch 27. Switch 27 may be the standard toggle type switch which is well known, or as one potential alternative, it may be a less well known but potentially more advantageous mercury switch. The advantage of a mercury switch would be that no noise or effort would be required to turn the sight on when bringing the bow and arrow into position for firing. A mercury switch is designed so that while the bow is in the horizontal position, the power source is off but immediately upon being raised to the vertical position, the power source would be turned on and as a result the light and sighting pins 17 would be activated.

The toggle switch as illustrated in the accompanying drawings and the mercury switch are but two potential embodiments for switches. Any of the well-known methods for turning batteries on and off would be viable alternatives. The only limiting variables are size, weight, noise production and adaptability to being carried through underbrush and other rough terrain.

Once the switch 27 has been turned on and the power source 11 activated, the light source 28 begins emitting light and more particularly light rays. These rays of light are picked up and conducted by optically conductive fibres. The optically conductive fibres are, of course, coated by a reflective material to minimize loss of intensity while the light is being conveyed. The conductive fibres themselves are generally made of a plastic or plastic-like material. Each individual optically conductive fibre has a diameter from about 5 mls. to about 25 mls., although this, of course, is not critical. For each optically conductive strand 14 approximately 5 to 15 fibres are combined. As mentioned before, the individual fibres are coated with a reflective material while the strands 14 are coated with a normal insulating type material. Each of the strands 14 leads to a sighting pin 17. There may be from one to ten sighting pins 17 on each sight. The number of sighting pins 17 will depend on the use to which the sight is to be put. In general, the more pins that are present, the greater the degree of accuracy that will be possible over a greater range of distances.

For strength purposes, as the fibre strands 14 exit from the power source housing 29 they are collected at a central point and protected by a rubber or plastic insulator 12. The various insulating and strength members found at this sighting unit 10 are necessary because of the potential rough usage of these sights. As one can appreciate, a bow having a sighting unit such as this mounted thereon is carried through woods or over other rough terrain, there is continual contact with brush, trees and other objects which could cause the disruption of the sighting accuracy of less well-made sighting units. At the point of attachment to sighting pins 17, the strands 14 are protected by plastic covers 15.

The light rays are conducted by the optically conductive fibres which, of course, are combined into strands 14 to sighting pin 17 and finally to a point of illumination 18. It is only the point of illumination 18 that is important from the archer's or rifleman's standpoint. This point of illumination is clearly visible to the person sighting the arrow or bullet. While being clearly visible to the person using the sight, it at the same time is not visible to any other person or any animal being hunted. This sighting unit is especially useful at night, in the early morning or at other points of time when sight is obstructed by natural or even artificial conditions. In bright daylight the user may wish to simply use the sighting pins to align targets. But at night when the sighting pins are not visible or are not clearly visible the light may be turned on to indicate the precise nature of the distances involved. Although, as stated previously, the number of sighting pins may vary from one to ten, a preferred number of sighting pins is four.

There are multiple adjustment means provided throughout the sighting unit. The first of these is pin adjustment means 19. Pin adjustment means 19 can be used to actually extend pin 17 in a direction which would put it in the position most comfortable and advantageous to the user. Pin adjustment means 19 are provided for each of said sighting pins 17. In addition, brace 22 is also adjustable. As can be seen from the attached drawings, brace 22 has attached to it power source housing 29 by bolt means 21. This relationship of power source housing 29 to brace 22 is fixed and is not movable. However, brace 22 is attached by bolt and nut 20 to brace 23. Brace 22 is movable in relationship to brace 23. Thus, the sighting pins 17 may be individually moved via pin adjustment means 16 and 19 or the pins may be individually moved via brace adjustment means 20.

Brace 23 is adaptable for use either as a left-handed or right-handed brace and can be mounted by a screw 26 on either side of a bow 25. Arrow guide 24 is shown in relation to where it generally appears in regard to sighting pins 17 and points of illumination 18.

Although the actual number of sighting pins 17 used with the sighting unit 10 is optional, a general rule can be stated that one sighting pin is enough for target archery while more than one is necessary for hunting purposes as during hunting the target is moving, whereas in target practice the target is stationary. As can be appreciated from the attached drawings, the pins are both vertically and horizontally adjustable which allows the sighting pins 17 to be totally adjusted to suit the individual user. This is very important as in archery the particular size of the user, or the particular strength of the user, or the type of arrow being shot, the wind, and other weather conditions are all variable which must be taken into consideration to insure accuracy. The fact that these sights are both vertically and horizontally adjustable allows for adjustments of this type to be conveniently accomplished with a minimum of effort.

Another feature of this invention is the fact that various colored optically conductive fibres which are now available can be used for individual strands 14. This would allow, for example, a sighting unit 10 to be constructed having four sighting pins 17. Each of the sighting pins 17 could be a different color with each color representing a different yardage. This would be especially convenient since all of these colors would result from a single white light source. This would be made possibly by the use of colored optically conductive fibres.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention and the scope of the claims are also desired to be protected.

The invention claimed is:

1. A sighting device for use in combination with an archery bow comprising:

a. a source of energy, said energy source being provided with a toggle switch, said toggle switch being manually operable to turn said source of energy on or off;

b. a source of light, said light source being connected to said source of energy through said switch;

c. flexible means for conducting said light;

d. from about 1 to about 10 adjustable light receiving sighting pins, said sighting pins being connected to said means for conducting light, each of said sighting pins comprising a tubular member bent at a 90° angle;

e. means for mounting said sighting device to an archery bow, said mounting means being adapted to mount said sighting device for either a left handed or a right handed position.

2. The device of claim 1 wherein said source of energy is a battery.

3. The device of claim 1 wherein said source of light is a red lens light.

4. The device of claim 1 wherein said source of light is a white lens light.

5. The device of claim 1 wherein said means for conducting said light comprise optically conductive fibres.

6. The device of claim 5 wherein said fibres are plastic.

7. The device of claim 1 wherein there is one of said sighting pins.

8. The device of claim 1 wherein there are four of said sighting pins.

9. The device of claim 1 wherein said sighting pins are vertically adjustable.

10. The device of claim 1 wherein said sighting pins are horizontally adjustable.

11. A sighting device for use in combination with an archery bow comprising:

a. a source of energy, said energy source being provided with a mercury switch operable to turn said source of energy on or off, said mercury switch being on when said sighting device is vertically aligned;

b. a source of light, said light source being connected to said source of energy through said switch;

c. flexible means for conducting said light;

d. from about 1 to about 10 adjustable light receiving sighting pins, said sighting pins being connected to said means for conducting light, each of said sighting pins comprising a tubular member bent at a 90° angle;

e. means for mounting said sighting device to an archery bow, said mounting means being adapted to mount said sighting device for either a left handed or a right handed position.

* * * * *